US005639979A

United States Patent [19]

Chen et al.

[11] Patent Number: 5,639,979

[45] Date of Patent: Jun. 17, 1997

[54] MODE SELECTION CIRCUITRY FOR USE IN AUDIO SYNTHESIS SYSTEMS

[75] Inventors: Iou-Din Jean Chen, Saratoga; Jimmy G. Lo, Cupertino, both of Calif.

[73] Assignee: OPTi Inc., Milpitas, Calif.

[21] Appl. No.: 557,687

[22] Filed: Nov. 13, 1995

[51] Int. Cl.[6] ..... G10H 1/00; G10H 1/18

[52] U.S. Cl. ..... 84/615; 84/653

[58] Field of Search ..... 84/615, 617, 618–620, 84/622–625, 627, 648, 653, 655–657, 659, 660, 663

[56] References Cited

U.S. PATENT DOCUMENTS

| | | | |
|---|---|---|---|
| 3,510,567 | 5/1970 | Fisher . | |
| 3,699,233 | 10/1972 | Suzuki . | |
| 3,881,387 | 5/1975 | Kawakami . | |
| 3,999,458 | 12/1976 | Suzuki . | |
| 4,018,121 | 4/1977 | Chowning . | |
| 4,106,383 | 8/1978 | Dittmar . | |
| 4,175,464 | 11/1979 | Deutsch . | |
| 4,249,447 | 2/1981 | Tomisawa . | |
| 4,253,367 | 3/1981 | Hiyoshi et al. . | |
| 4,256,004 | 3/1981 | Takeuchi . | |
| 4,283,983 | 8/1981 | Kashio . | |
| 4,300,435 | 11/1981 | Schmoll, III . | |
| 4,301,704 | 11/1981 | Nagai et al. . | |
| 4,422,362 | 12/1983 | Chibana . | |
| 4,453,441 | 6/1984 | Deutsch . | |
| 4,485,717 | 12/1984 | Kitagawa . | |
| 4,554,857 | 11/1985 | Hishimoto . | |
| 4,569,268 | 2/1986 | Futamase et al. . | |
| 4,616,546 | 10/1986 | Uchiyama et al. . | |
| 4,643,066 | 2/1987 | Oya et al. . | |
| 4,747,332 | 5/1988 | Uchiyama et al. . | |
| 4,788,896 | 12/1988 | Uchiyama et al. | 84/1.01 |
| 4,813,326 | 3/1989 | Hirano et al. . | |
| 5,281,756 | 1/1994 | Kawashima | 84/615 |

FOREIGN PATENT DOCUMENTS

| | | |
|---|---|---|
| 48720 | 5/1978 | Japan . |
| 7570 | 4/1979 | Japan . |
| 7733 | 1/1980 | Japan . |
| 142397 | 11/1980 | Japan . |
| 29519 | 6/1983 | Japan . |

OTHER PUBLICATIONS

D. Multrier, IBM Technical Disclosure Bulletin: Tone Generator (May 1978) vol. 20, No. 12, p. 5196.

Yamaha Corporation, OPL3–L YMF 289B FM Snythesizer Applciation Manual (Nov. 1994) pp. 1–47.

Yamaha Corporation, YMF262 FM Operator Type L3 (OPL3) (Jul. 1993) pp. 1–21.

The FM Synthesizer, pp. 15–2 through 15–25.

*Primary Examiner*—Jonathan Wysocki
*Assistant Examiner*—Marlon T. Fletcher
*Attorney, Agent, or Firm*—Flehr Hohbach Test Albritton & Herbert LLP

[57] ABSTRACT

An audio synthesis circuit is disclosed that can generate multiple audio tones, or operators, each having different harmonic characteristics. The audio synthesis circuit can be used in a time-multiplexed fashion so that the multiple audio tones, or operators, can be computed in a single audio synthesis cycle and then combined to form voices/channels. Each audio synthesis cycle can be divided into as few as 0 or as many as 48 time slots, meaning that as many as 48 operators can be played simultaneously. The disclosed circuit provides a preset organization of the 48 operators into 12 2-operator channels and 6 4-operator channels. These channels can be played in various system modes, including backward-compatible 2- and 4-operator modes in which the programming of the operators is restricted, and an enhanced mode, in which the operators can be freely programmed. In the backward-compatible modes, two operators of each 4-operator channel are constrained to be duplicates of a respective 2-operator channel. Consequently, it is not possible for two different 2-operator voices to be made by playing one four operator voice in the 2-operator mode. Instead, when a 4-operator voice is played in the 2-operator mode, only one two-operator channel results, using the non-duplicated operators. Similarly, playing a 4-operator channel in 4-operator mode turns off the corresponding 2-operator channel, and playing a 2-operator voice turns off the duplicate operators of a later-activated 4-operator voice.

26 Claims, 7 Drawing Sheets

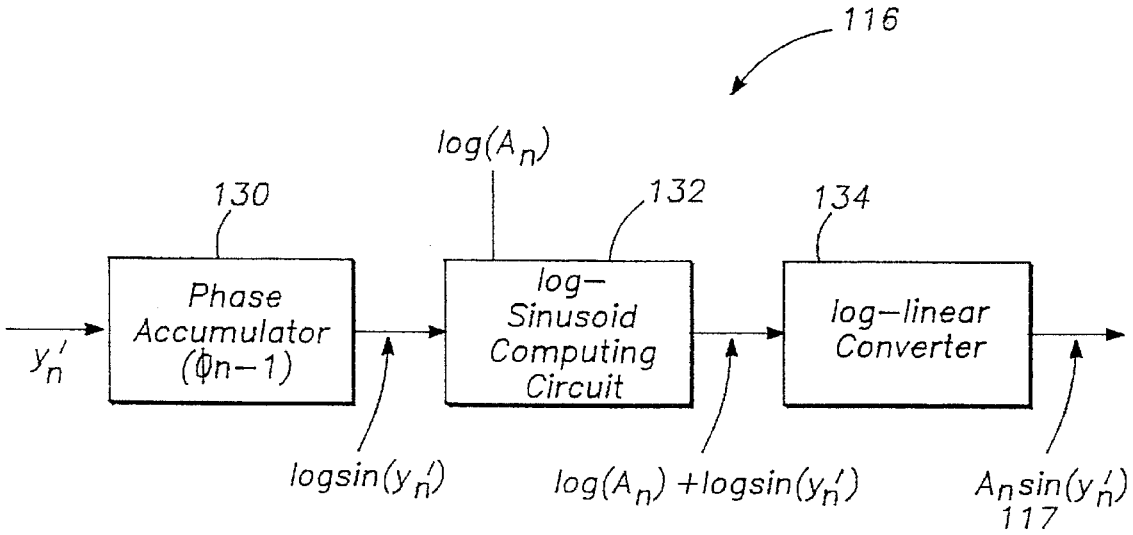
FIG.−2A
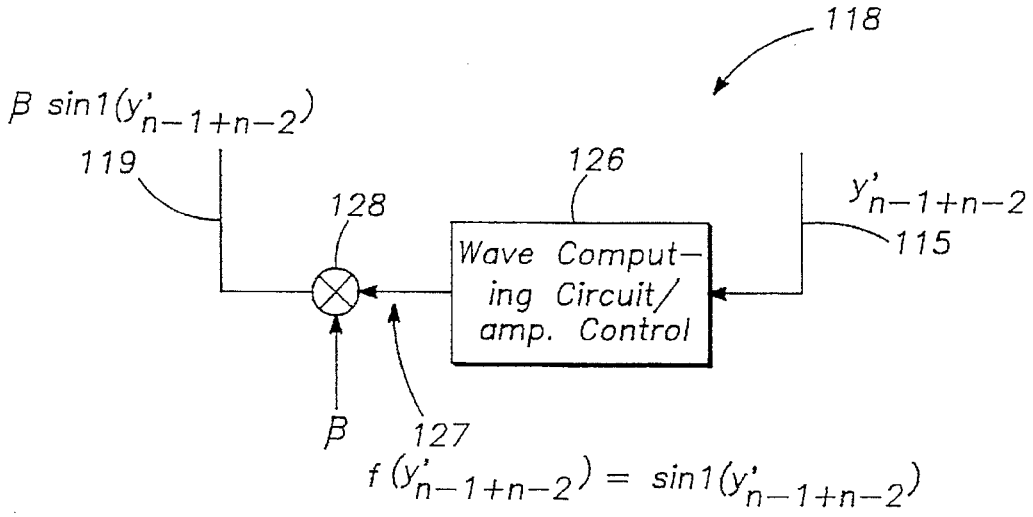
FIG.−2B

MODE SELECTION CIRCUITRY FOR USE IN AUDIO SYNTHESIS SYSTEMS

The present invention relates generally to audio tone synthesis systems and, particularly, to mode selection circuitry for audio synthesis systems.

BACKGROUND OF THE INVENTION

It is well-known that frequency modulation (FM) techniques can be used to synthesize harmonically-rich audio tones that are suitable for use in musical instruments (note: the term "frequency modulation" as used herein encompass any audio synthesis technique where the phase or frequency of a carrier signal is varied as a function of the content of a modulating signal).

Several such techniques are disclosed in U.S. Pat. No. 4,249,447, entitled "Tone production method for an electronic musical instrument." In each of the techniques disclosed in the '447 patent, the color of the synthesized output tone is at least partially modified by multiplying the modulating signal (say, sin(y)) by some feedback parameter (β) then feeding back the resulting product (βsin(y)) to be added to the phase of the carrier signal, thereby forming an updated (modulated) carrier phase value (y). The updated carrier phase value (y) is then input to a sinusoidal memory, which in response outputs the next value of the modulating signal (sin(y)).

The different techniques of the '447 patent can be used to synthesize audio tones with different characteristics (e.g., a square wave or a sine wave) by providing different types of feedback among the aforementioned basic components. However, audio synthesis circuits that implement the methods disclosed in the '447 patent are likely to introduce systematic inaccuracies in the phase signal (y) because, in each embodiment of the '447 patent, the signal being fed back to modify the current phase (y) is derived from a sinusoidal signal (e.g., sin(y)) output from a sinusoid memory/circuit.

This is because, in the art of audio synthesis, a sinusoid function is typically implemented as a logsin function followed by an addition and then a log-linear conversion. In this process, the current phase ($y_n$) is input to a logsin function/memory, which outputs the log of sin(y) (i.e., logsin($y_n$)). The logsin signal (logsin($y_n$)) is then commonly added to a log-amplitude signal (log(A)) related to the envelope of the tone being synthesized. The resulting sum (log(A)+logsin($y_n$)) is then converted to a linear output signal (Asin($y_n$)) by a log-linear converter. These steps eliminate the need for an additional multiply, which is more costly than an addition and reduce the chance of computation overflow occurring. However, because information is lost in the logsin/addition/log-linear conversion process, the final result is less accurate (i.e., has fewer reliable lower-order bits) than if Asin($y_n$) were computed directly. In the FM audio synthesis systems employing methods of the '447 patent, these inaccuracies are accentuated by the fact that the resulting Asin($y_n$) signal is multiplied by a modulation index (β), then that product is used to generate the phase value for the next audio synthesis cycle ($y_{n+1}$). As a result, the current phase value is systematically thrown off during a synthesis operation.

Thus, there is a need for an audio synthesis circuit that does not feed back a sinusoid signal that is likely to have been log-linear converted. Ideally, such an audio synthesis circuit would instead feed back the current phase, compute a modulation factor from the current phase without using log-linear conversion, then form the next phase using that modulation factor. So that a wide variety of harmonics can be produced by this ideal system, the modulation factor should optionally be computed according to a function that differs from the sinusoidal function used to compute the output tones. The circuit should be structured so that this phase modulation operation is not applied to the output audio signal being synthesized.

For compatibility with legacy systems, i.e., audio synthesis systems that were designed around prior art audio synthesis circuits, these new audio synthesis circuits should provide a variety of legacy modes that are backward-compatible with audio synthesis modes provided by the prior art audio synthesis systems. For example one prior art system, the Yamaha OPL-3 audio synthesis chip, provides two modes, a 2-operator mode and a 4-operator mode, which allow a user to define complex audio voices by combining, respectively, 2 or 4 operators (each corresponding to an audio tone with different characteristics, such as frequency, envelope and harmonic content). In the OPL-3 chip, the association of operators and voices is fixed and no operator is used in more than one voice. For example, in the 4-op mode, the 36 operators might be allocated to six, four-operator voices and six, two-operator voices as follows:

| Voice | Operators |
|---|---|
| 1 | 1,2,3,4 |
| 2 | 5,6,7,8 |
| 3 | 9,10,11,12 |
| 4 | 13,14,15,16 |
| 5 | 17,18,19,20 |
| 6 | 21,22,23,24 |
| 7 | 25,26 |
| 8 | 27,28 |
| 9 | 29,30 |
| 10 | 31,32 |
| 11 | 33,34 |
| 12 | 35,36 |

In the 2-op mode, two-operator voices are provided by subdividing the four-operator voices. I.e., the six, 4-op voices available in the 4-op mode become twelve 2-op voices in the 2-op mode. While this scheme allows a user to flexibly form 2-op or 4-op voices from the fixed set of operators, it also precludes a user who chooses to play a 2-op voice from playing the corresponding 4-op voice from which the 2-op voice was formed.

Thus, there is a need for mode selection circuitry for use in audio synthesis systems that provides backward-compatibility with prior art modes, while also providing an enhanced mode that does not preclude a user from simultaneously playing two and four operator voices, which, in the prior art would be corresponding and, therefore, non-playable.

SUMMARY OF THE INVENTION

In summary, the present invention is a mode selection circuit and method that can be used to control the mode of operation of audio synthesis systems.

More particularly, the present invention is a mode selection system for use with an audio synthesis system that is configured to generate audio tones, or operators, and combine unique subsets of the operators to form a plurality of respective audio voices, or melody channels. The present mode selection system includes a plurality of mode registers, each of which indicates for a respective one of the channels a channel mode in which the channel is to be played. Each channel mode is selected from a N/2-operator mode or a N-operator mode, N being an even integer greater than 2, and all of the channels are composed of at least N/2 operators. The present invention also incorporates a dynamic state machine that controls operations of the audio synthesis system based at least partly on contents of the mode registers. For example, when the channel mode is the N/2-operator mode, the dynamic state machine causes the audio synthesis system to play N/2 of the subset of operators composing the channel when the channel is activated. And, when the channel mode is the N-operator mode, the dynamic state machine causes the audio synthesis system to play the lesser of: (1) N of the subset of operators composing the channel and (2) all of the subset of operators when the channel is activated, the number of available channels always being a fixed number regardless of the channel mode.

The present invention is also a mode selection method for use with an audio synthesis system. One step of the present method involves setting for the melody channels a channel mode in which each of the melody channels is to be played. As described above, the channel mode can be selected from a N/2-operator mode or a N-operator mode, N being an even integer greater than 2, and each of the melody channels is either a N/2-operator channel or a N-operator channel. The present method also involves controlling channel formation operations of the audio synthesis system based at least partly on the channel modes. I.e., when the channel mode for any melody channel is the N/2-operator mode, the present method causes the audio synthesis system to play N/2 of said subset of operators composing said any melody channel when said any melody channel is activated. Also, when the channel mode for any melody channel is said N-operator mode, the present method causes the audio synthesis system to play the lesser of: (1) N of said subset of operators composing said any melody channel and (2) all of said subset of operators composing said melody channel when said melody channel is activated, so that the number of available melody channels is always a fixed number regardless of said channel modes.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENT

Figure 1:
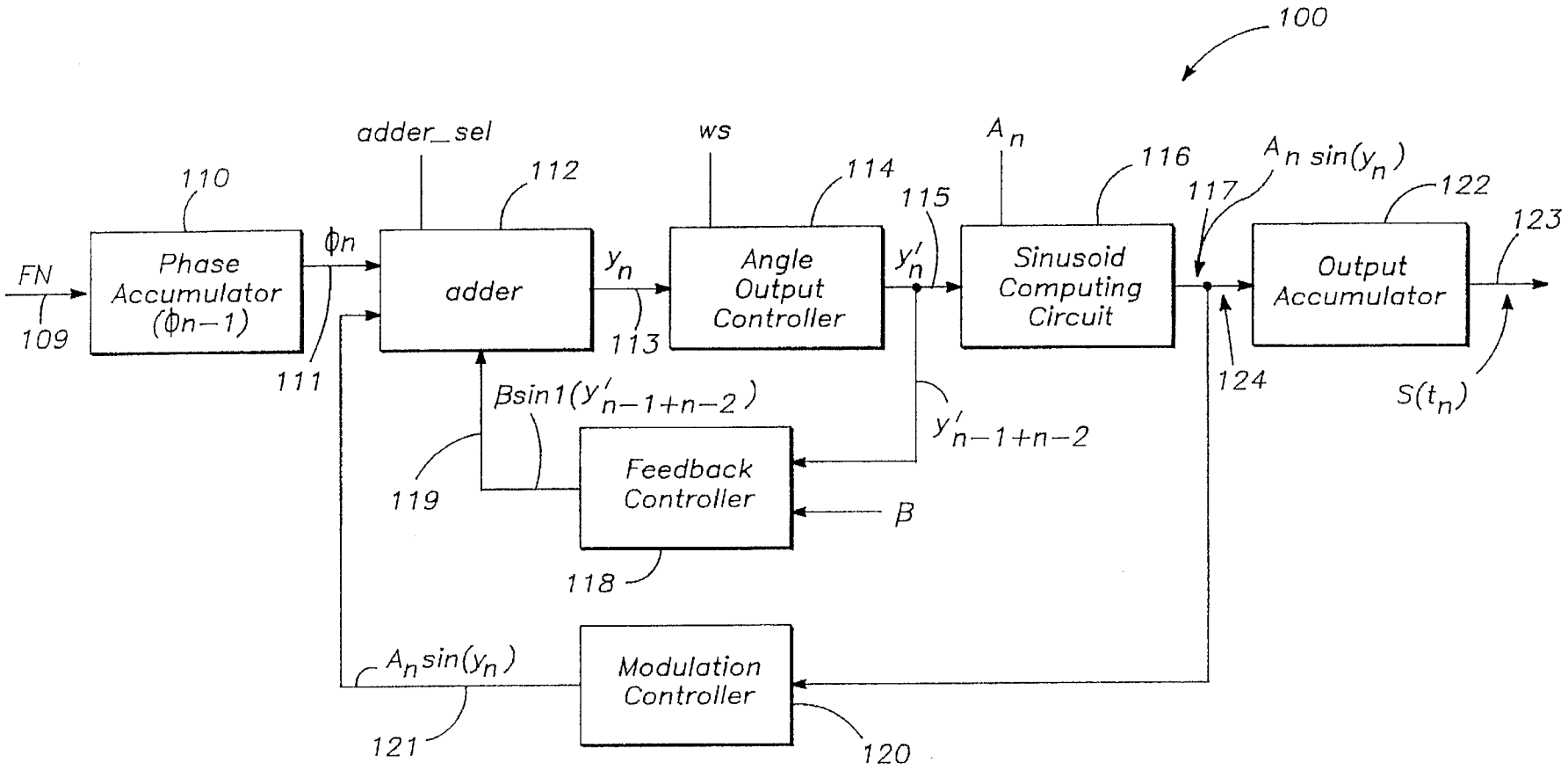
FIG. 1 is a block diagram of the preferred embodiment.

Referring to FIG. 1, there is shown a block diagram of the preferred embodiment, which includes a phase accumulator 110, an adder 112, an angle output controller 114, a sinusoid computing circuit 116, a feedback controller 118, a modulation controller 120 and an output accumulator 122.

The preferred embodiment employs the elements of FIG. 1 on a time-shared basis to generate a carrier signal and then a modulating signal that are combined to generate a frequency modulated (FM) audio tone. However, not all of the elements of FIG. 1 are used to generate all components of the synthesized audio signal. For example, the feedback controller 118 is only used to modulate the phase angle of the modulating signal, whereas the modulation controller 120 is only used to modulate the carrier signal. This multiplexed use of the circuit elements is made possible by a switch at the node 124, which routes the sinusoid computing circuit's output signal to the outer loop to modulate the carrier and to the output accumulator 122 to be used to form the synthesized audio tone $S(t_n)$ 123. Also enabling this behavior is an input selection circuit in the adder 112 that selects either the output from the feedback controller 118 or the modulation controller 120 to be added to the accumulated phase value 111 in response to an adder select ("adder_sel") signal.

In the preferred embodiment, these elements are integrated onto a single audio synthesis chip; however, they could also be realized as discrete, interconnected electronic components or as functional blocks within a computer program. Also, the preferred embodiment is described with reference to a digital circuit that operates at discrete time intervals. However, the techniques employed by the preferred embodiment are equally applicable to analog circuits where signals are continuous.

Referring to FIG. 1, the operation of elements of the preferred embodiment is now described. The phase accumulator 110 receives an input 109 called a frequency number (FN) that is correlated with the frequency of a tone to be generated within the circuitry 100. A particular FN value is related to the number of phase increments (radians, degrees, etc.) the phase accumulator 110 must accumulate into the current phase value to generate an accumulated phase value ($\phi n$) 111 for the next audio synthesis cycle. For example, if audio synthesis computation cycles occur at a clock rate of 44 KHz, to generate a 1 KHz audio tone, for each clock cycle the phase accumulator 110 has to add $2\pi/44$ radians to the current phase increment. The phase accumulator 110 keeps all accumulated phase values 111 within the range of 0 and $2\pi$ by subtracting, when necessary, $2\pi$ radians from the resulting output phase increment.

The phase accumulator 110 outputs the current accumulated phase value 111 to the adder 112, which adds the accumulated phase value 111 to either the signal 119 from the feedback controller 118 or the signal 121 from the modulation controller 120, depending on whether the audio synthesis circuitry 100 is being used, respectively, to generate a modulating signal or a carrier signal modulated by that modulating signal. The adder 112 selects the signal to add to the current accumulated phase value 111 in response to the adder select signal ("adder_sel"), which can take two values, corresponding to the two inputs. The adder 112 then outputs the result, a modulated phase signal 113 ($y_n$), to the angle output controller 114.

The angle output controller 114, in addition to receiving the modulated phase signal 113 ($y_n$) from the adder, also receives a waveform select index signal (WS) whose value can be selected from multiple enumerated values. For each enumerated value of the WS signal, the angle output controller 114 generates an augmented phase signal value 115

($y_n'$) by applying a corresponding, unique phase generation function to the current value of the phase signal 113 ($y_n$). The angle output controller 114 then outputs the augmented phase signal value 115 ($y_n'$) to the sinusoid computing circuit 116 and the feedback controller 118, each of which computes the value of their respective functions at the current augmented phase signal value 115. By modifying the accumulated phase 113 in this way, the shape and harmonic content of the outputs generated by the feedback controller 118 and the sinusoid computing circuit 116 can be varied predictably.

Figure 2C:
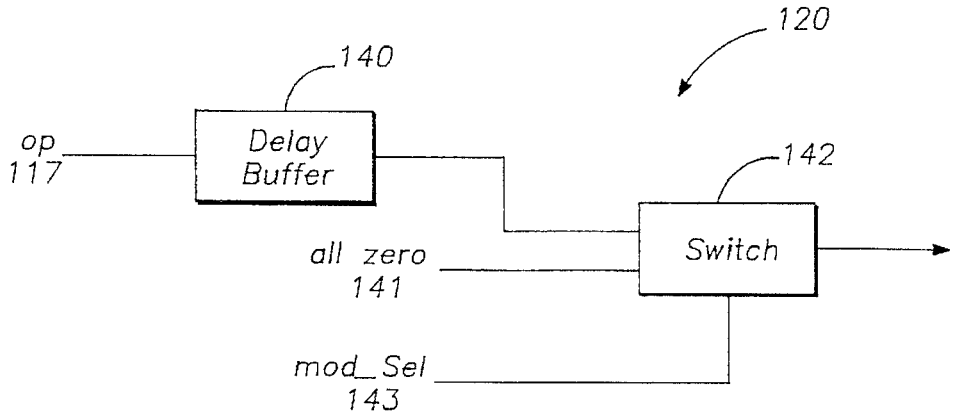
FIG. 2C is a block diagram of the modulation controller shown in FIG. 1.
Figure 2D:
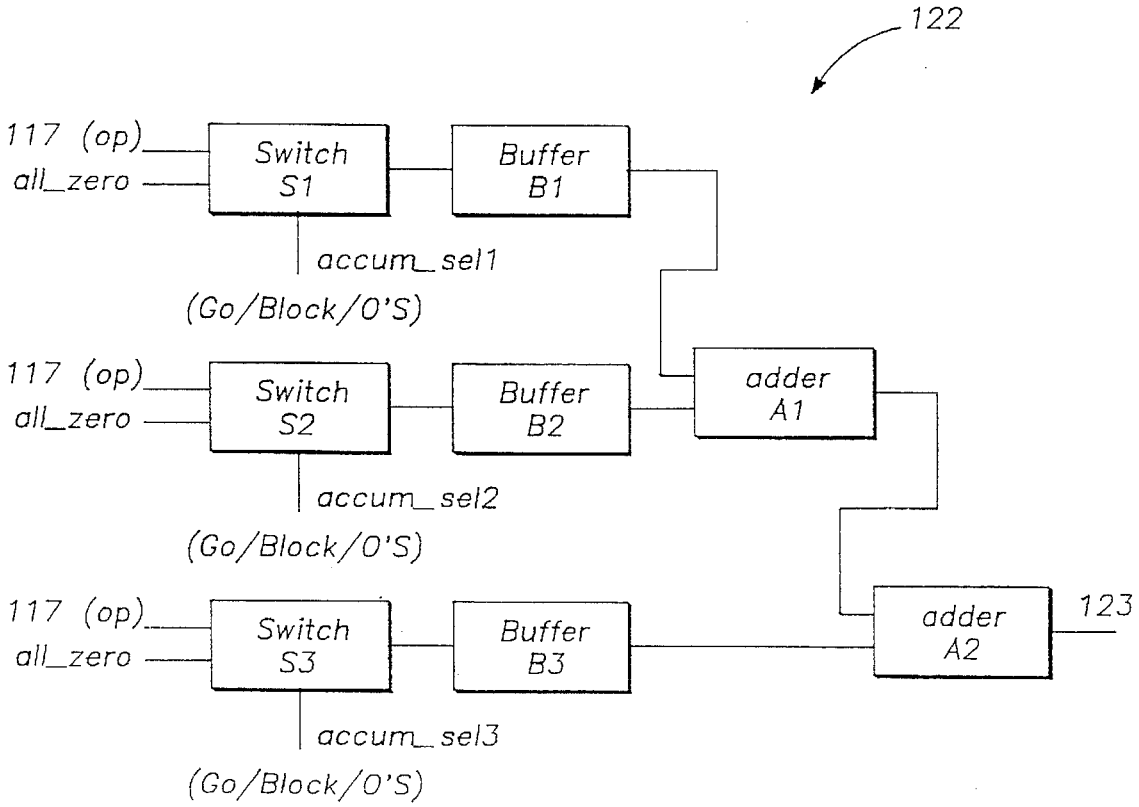
FIG. 2D is a block diagram of the output accumulator shown in FIG. 1.
Figure 2A:
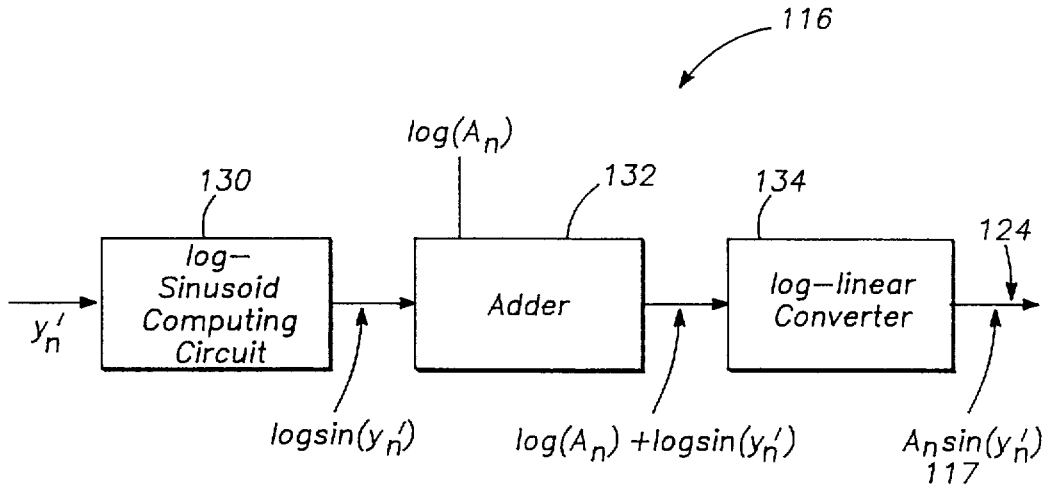
FIG. 2A is a block diagram of the sinusoidal computing circuit shown in FIG. 1.

As shown in FIG. 2A, the sinusoid computing circuit 116 consists of a log-sinusoid computing circuit 130, an adder 132 and a log-linear converter 134, all serially connected. The log-sinusoid computing circuit 130 is an optimized, combinational logic circuit that computes the logsin of the current augmented phase signal value 115 ($y_n'$). The resulting logsin($y_n'$) signal is added to an envelope amplitude (log($A_n$)) by the adder 132. The log-linear converter 134 then converts the output sum (log($A_n$)+logsin($y_n'$)), to a linear signal 117 ($A_n$sin($y_n'$)). Note that this signal is not fed back to the adder 112 to generate the next phase 113, but is instead output to the modulation controller 120 and the output accumulator 122, neither of which are used to modulate the current modulated phase signal 113 ($y_n$). This linear output signal 117 is the basic building block from which the present audio synthesis circuitry 100 generates different, harmonically complex tones. By selecting different combinations of the various input parameters, such as frequency number (FN), wave select index (WS), modulation index (β) and envelope amplitude ($A_n$), many different types of linear output signals 117, each corresponding to a specific "operator", can be generated. Furthermore, different ones of these operators can be combined in predetermined ways (using the modulation controller 120 and the output accumulator 122) to generate the harmonically complex voices 123 that are output from the accumulator 122. For example, using the audio synthesis circuitry 100, voices can be generated by serial modulation of operators (where one operator serves as the modulating signal for another operator) or addition (where operators are added together). Also, through the operation of the accumulator 122, hybrid voices can be generated from combinations of serially modulated and additively generated voices.

Figure 2B:
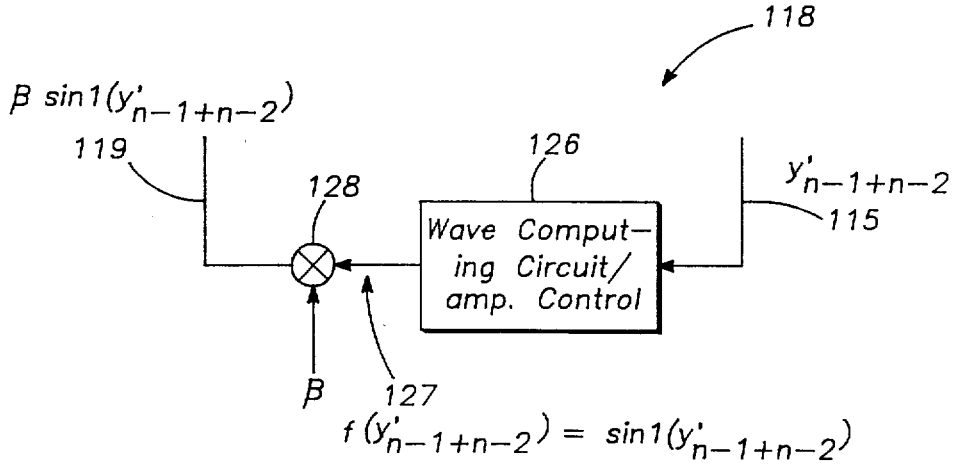
FIG. 2B is a block diagram of the feedback controller shown in FIG. 1.

Referring to FIG. 2B, there is shown a block diagram of the feedback controller 118, which includes a wave computing circuit 126 and a multiplier 128. The wave computing circuit 126 is an optimized, combinational logic circuit that takes as its input the augmented phase signal value 115 and generates an output 119 by computing the value of a particular periodic function (which we shall hereinafter refer to as sin1) at a value that is a scaled combination (denoted $y'_{n-1+n-2}$), of the previous two augmented phase signal values 115. The multiplier 128 then multiples the output 127 (sin1($y'_{n-1+n-2}$)) by a modulation index (β) and directs the result (βsin1($y'_{n-1+n-2}$)) to the adder 112, which, during the subsequent audio synthesis cycle, adds the result (hereinafter called a modulation factor) to the current accumulated phase value ($\phi_n$) for the same operator. Note that this modulation factor is not subject to log-linear conversion and therefore is not likely to introduce systematic calculation errors into the computed operator values.

Referring to FIG. 2C, there is shown a block diagram of the modulation controller 120, which includes a delay buffer 140 and a switch 142. The delay buffer 140 is coupled to the output 117 of the sinusoid computing circuit 116 (i.e., the current value of a particular operator). The buffer 140 stores the operator's current value and outputs the stored value to the switch 142, which also is coupled to an all-zero input 141 and a one-bit modulation-select signal 143. When the modulation-select signal is set, the modulation controller 120 outputs the stored operator value to the adder 112. This allows the operator value just computed to be used as the modulating signal for a different operator being computed during the subsequent time division (or time slot) in the same audio synthesis cycle. Hereinafter, this operation shall be called "serial modulation". Note that this serial modulation operation is completely different from the phase modulation operation described above, which applies only to a single operator (i.e., not among different operators) and which occurs between corresponding time slots in subsequent audio synthesis computation cycles. When the modulation-select signal is not set, the modulation controller outputs the all-zero signal to the adder. It should be apparent to one skilled in the art that, in this situation, no serial modulation occurs.

Referring again to FIG. 1, in addition to being used by the modulation controller 120, each operator 117 is also output to the output accumulator 122, which is responsible for forming the output tone 123 (S($t_n$)) (also called a voice or channel) from the audio synthesis circuitry 100. The output accumulator 122 generates the voices 123 by forming a limited number of different connections between the operators making up a voice. For example, the output accumulator 122 can add the two operators from which a two-operator voice is to be formed or output the single operator that results from a serial modulation operation in which four operators are combined to form a single voice. The output accumulator 122 forms these combinations by storing up to three audio tones (some of which can be serially modulated) and then adding the stored tones to form the different output voices, including audio voices that are hybrids of purely additive and serially modulated audio tones. In the preferred embodiment, the possible combinations of audio tones, or operators, that can be generated by the output accumulator 122 are limited to four combinations that can be generated for a four-operator voice and two possible combinations (already described) that can be generated for a two-operator voice. The four-operator combinations include (1) a serially modulated voice using the four operators, (2) a sum of two, two-operator serially modulated audio tones, (3) a sum of a two-operator serially modulated audio tone and the remaining two operators, and (4) the sum of a three-operator serially modulated audio tone and the remaining operator.

A block diagram of the output accumulator is shown in FIG. 2D. The output accumulator 122 includes three switches S1, S2 and S3, each receiving the same two inputs, an operator (op) 117 (from the sinusoid computing circuit 116) and an all zero input "all_zero", and sending an output to the buffers B1, B2, and B3, respectively. The buffers are coupled to one of two adders A1, A2, the second of which generates the output audio voice 123. Consequently, the output audio voice 123 is the sum of the contents of the three buffers B1, B2, B3 (note that in no case are more than four operators combined into the output voice 123). The switches S1, S2, S3 respectively receive two-bit select signals accum_sel1, accum_sel2, and accum_sel3, where each select signal has three possible values, "GO", "BLOCK" and "0's". When its accum_sel value is "GO", a switch passes the operator to its respective buffer, which stores the operator 117, overwriting its contents in the process. When the accum_sel value is "0's", the respective switch passes the "all zero" input to the buffer, which, as a result, overwrites its contents with zeros. When its accum_sel value is "BLOCK", a switch blocks all signals, meaning that the buffer contents are not overwritten.

The switches S1, S2, S3 and the buffers B1, B2, B3 are controlled differently via the selects accum_sel1, accum_sel2, accum_sel3, depending on whether the multi-operator channel is generated by adding various ones of the operators or by modulating one operator with others of the operators. For example, if a serially-modulated 4-op voice is to be generated from the operators 1,2,3,4 (combination (1) from above), the desired 4-op voice would be produced by setting the select signals as shown in Table 1, which also shows the result of each accumulator operation. Please note that in each of the four time slots, the same operator 117 is input to each of the switches S1–S3 and that the output accumulator 122 only generates an output channel 123 following the last time slot.

TABLE 1

| time slot # | op # | SEL1, SEL2, SEL3 | result |
|---|---|---|---|
| 1 | op-1 | GO, 0's, 0's | OP1 → B1 |
| 2 | op-2 | GO, 0's, 0's | OP2 → B1 |
| 3 | op-3 | GO, 0's, 0's | OP3 → B1 |
| 4 | op-4 | GO, 0's, 0's | OP4 → B1; add B1(OP4), B2(0) and B3(0); output sum = OP4. |

In contrast, if a voice is to be produced involving the addition of some of its constituent operators, the present invention employs at least one of the other buffers B2 and B3. For example, to produce the 4-op voice (op-1 mod op-2)+op-3+op-4 (where "mod" means that op-1 modulates op-2) the select signals would be set as shown in Table 3 for the four time slots.

TABLE 2

| time slot # | op # | SEL1, SEL2, SEL3 | result |
|---|---|---|---|
| 1 | op-1 | GO, 0's, 0's | OP1 → B1 |
| 2 | op-2 | GO, 0's, 0's | OP2 → B1 |
| 3 | op-3 | BLOCK, GO, 0's | OP3 → B2 |
| 4 | op-4 | BLOCK, BLOCK, GO | OP4 → B3; add B1(OP2), B2(OP3) and B3(OP4); output sum. |

Further details of the operations of the feedback controller 118 and the modulation controller 120 will be provided in the following discussion of the method of operation of the preferred embodiment.

Figure 3:
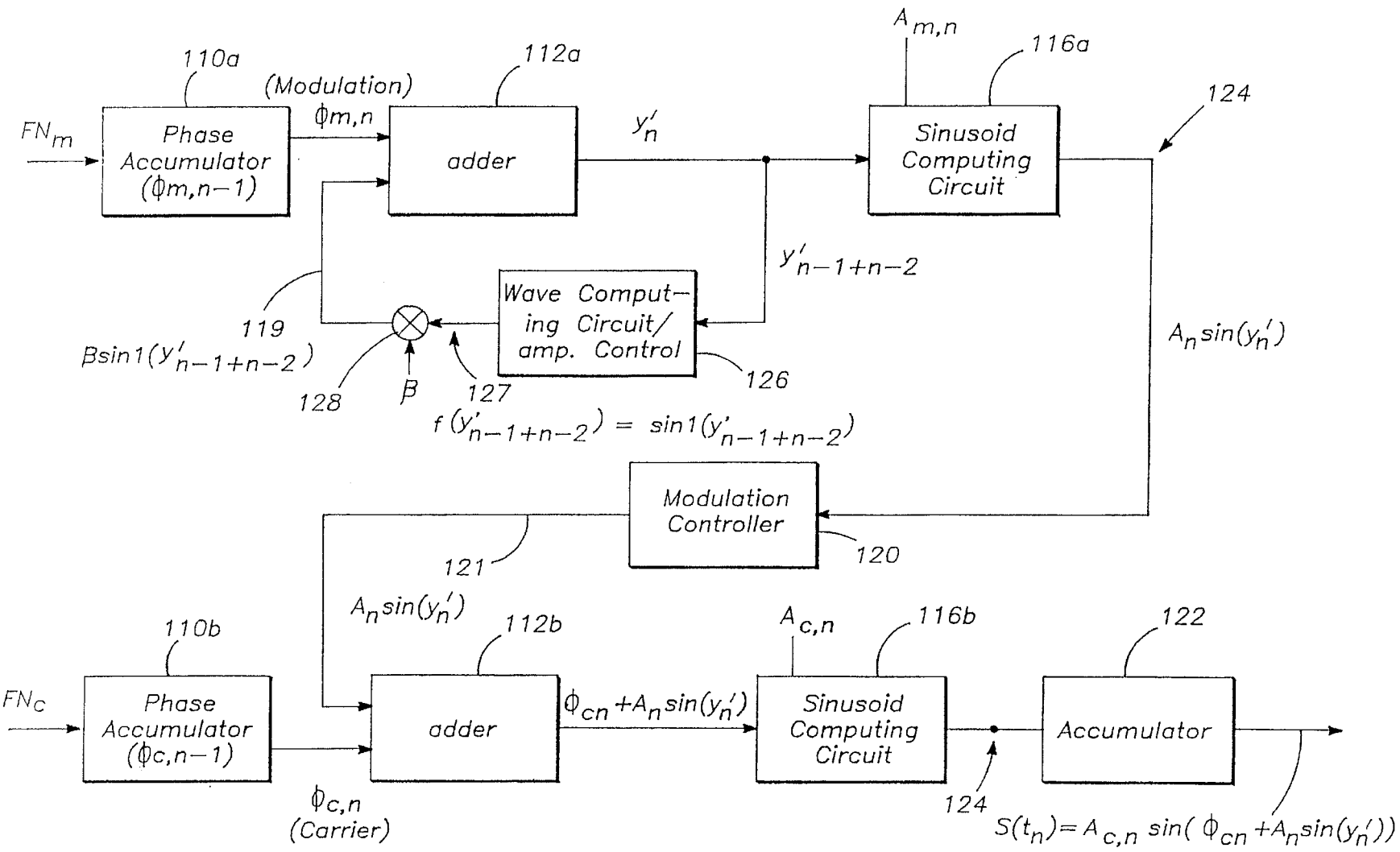
FIG. 3 is a block diagram of the preferred embodiment showing how the elements of FIG. 1 combine to form a FM signal from two operators.

FIG. 3 shows how the circuitry of FIG. 1 is used to generate an output voice 123 ($S(t_n)$) that results from modulating a second operator (the carrier) using the value of a first operator (the modulation). Those elements of FIG. 1 used to generate the modulation signal are shown at the top of FIG. 3, and those elements used to modulate the carrier with the modulation signal are shown at the bottom of FIG. 3. Because the circuit elements of FIG. 1 are time multiplexed, FIG. 3 repeats those elements used to generate both the first and second operators during the first and second time slots, respectively. Thus, the phase accumulator 110, adder 112 and sinusoid computing circuit 116 are each depicted twice, as the phase accumulators 110*a*, 110*b*; adders 112*a*, 112*b*; and sinusoid computing circuits 116*a*, 116*b*.

FIG. 3 also slightly rearranges the elements of FIG. 1, combining some and subdividing others, to better illustrate the audio synthesis implementation of the preferred embodiment. Specifically, the phase angle output controller 114 has been combined with the adder 112, and the feedback controller 118 of FIG. 1 is shown subdivided into its two constituent elements, a multiplier 128 and a wave computing circuit 126. The remainder of this description of the audio synthesis approach of the present invention refers to the implementation depicted in FIG. 3.

As the first step in the calculation of the first operator (the modulation), the phase accumulator 110*a* computes the accumulated phase $\phi_{m,n}$ of the modulating signal for the current computation cycle by (1) accumulating a phase increment (based on the modulation frequency number $FN_m$) into the accumulated phase $\phi_{m,n-1}$ from the previous cycle (the subscript n−1 denotes a signal from the previous synthesis cycle), and (2) transposing the resulting sum so that $\phi_{m,n}$ lies between 0 and $2\pi$. The accumulator outputs the current accumulated phase $\phi_{m,n}$ to the adder 112, which also receives a feedback signal $\beta\sin\mathbf{1}(y'_{n-1+n-2})$ from the feedback controller 118. The adder adds these two inputs and outputs the resulting modulated phase signal $y_n'=\phi_{m,n}+\beta\sin\mathbf{1}(y'_{n-1+n-2})$ to the sinusoid computing circuit 116 and the waveform computing circuit 126. From the modulated phase signal, the log-sinusoid computing circuit 130 computes a corresponding logsin signal ($\log\sin(y_n')$, or $\log\sin(\phi_{m,n}+\beta\sin\mathbf{1}(y'_{n-1+n-2}))$. The second adder 132 adds this logsin signal and an amplitude signal ($\log(A_{m,n})$) that defines the current envelope value (amplitude) of the first operator. The resulting sum is then converted by the log-linear converter 134, yielding the modulation signal, or first operator, $A_{m,n}\sin(y_n')$, or $A_{m,n}\sin(\phi_{m,n}+\beta\sin\mathbf{1}(y'_{n-1+n-2}))$. The first operator is then output to the modulation controller 120, where it will be used to modulate the phase of the second operator.

In the second time slot, the circuitry 100 is used to modulate a second operator (the carrier) using the first operator that was computed in the first time slot. Because this is a serial modulation operation, the modulation select signal is set so that the modulation controller outputs the first operator value 117 to the adder 112*b* in unison with the current carrier accumulated phase $\phi_{c,n}$ (computed using the carrier frequency $FN_c$, which is identical to $FN_m$) from the phase accumulator 110*b*. The adder 112*b* then adds the two signals, yielding a modulated carrier phase of $\phi_{c,n}+A_{m,n}\sin(y_n')$, which is output to the sinusoid computing circuit 116*b*. As a result, the sinusoid computing circuit 116*b* computes and the output accumulator 122 outputs the serially modulated audio voice (or channel) characterized by the expression $S(t_n)=A_{c,n}\sin(\phi_{c,n}+A_{m,n}\sin(y_n'))$.

We have discussed in reference to FIG. 3 how the preferred embodiment generates a generic voice (or channel) from two operators, where the first operator generated in a first time slot is used as the modulating signal for the second operator generated in a second time slot. More generally, the audio synthesis circuitry 100 of FIG. 1 can be used to generate, through the same type of time-multiplexed operation, multiple output voices (or channels), each consisting of selectable combinations of two or four different operators. For example, the circuitry 100 of FIG. 1 could also generate a two-operator voice in which the same two operators are added together instead of being serially modulated.

Figure 4:
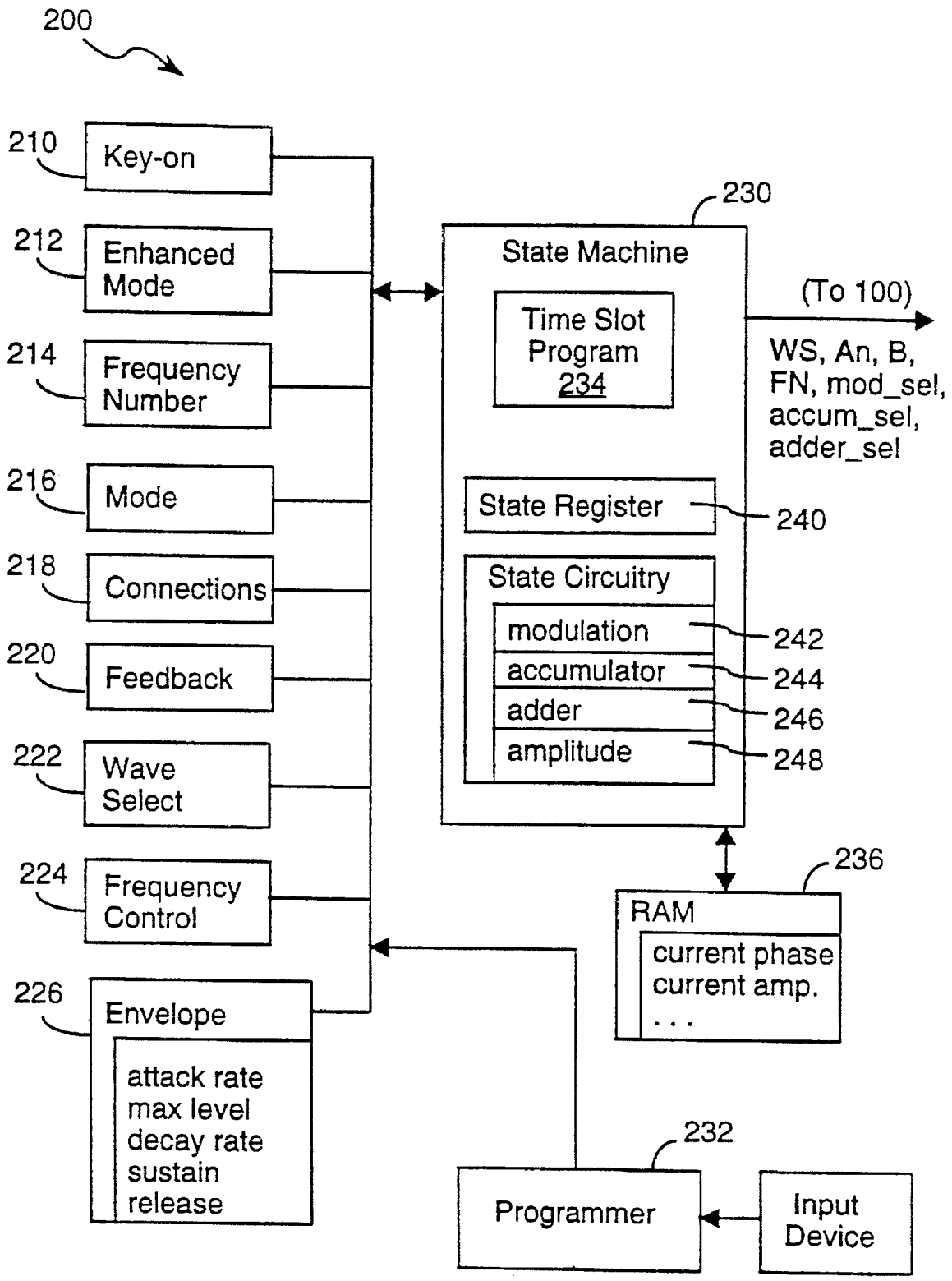
FIG. 4 is a block diagram of the audio synthesis control circuitry of the present invention.

This is made possible by the control circuitry 200 of FIG. 4, which enables the audio synthesis circuitry 100 (FIG. 1) to obtain, at appropriate time intervals (i.e., at time slot boundaries), the different audio parameters (e.g., $\beta$, $A_n$, WS, FN) corresponding to the different operators being played, and control signals (e.g., mod_sel, accum_sel, adder_sel)

indicating how to combine the different operators to generate the desired channels/voices.

The control circuitry 200 (FIG. 4) includes four basic sets of components, program registers 210–226, a programmer 232, a random access memory (RAM) 236, and a dynamic state machine 230, which includes a time slot program 234, a state register 240 and state circuitry 242–248. The state machine 230 controls the audio synthesis circuitry 100 based on the contents of the program registers 210–226 and the processing state (encapsulated in the state registers and circuitry 240–248) of the audio synthesis circuitry 100 as the various operator and channels are generated. The contents of the program registers 210–226 are written by the programmer 232 in response to user inputs (e.g, keyboard inputs) or a computer program (e.g., a game). The program registers 210–226 are subdivided among channel registers 210–220, which include parameters that are relevant to the generation of multiple-operator channels, and operator registers 222–226, which include parameters that determine how the synthesis circuitry 100 generates the respective operators that compose the channels. There is one set of channel registers for each channel that can be generated by the audio synthesis circuitry (except for the enhanced mode register 212, of which there is only one that applies to all channels) and one set of operator registers for each operator that can be generated. The internal state register 240 is used by the state machine 230 to store state information, such as the identity of the operator currently being played). Based on the state information in the state register and the information in the program registers 210–226, the state circuitry 242–248 generates the set of signals that control the modulation controller 120, output accumulator 122, adder 112 and sinusoid computing circuit 116 so that those elements cooperate to generate the appropriate operator and channel.

A channel register set includes a key-on register 210, enhanced mode register 212, frequency number (FN) register 214, mode register 216, one connection register 218 for every two-operators composing the channel and a feedback register 220. The key-on register 210 includes a single bit that indicates when the corresponding voice/channel is being played on some input device coupled to programmer 232 (and is therefore to be generated by the audio synthesis circuit 100). The enhanced mode register 212 and the mode register 216 collectively indicate the audio synthesis mode (described below) for each channel (note that there is one enhanced mode register 212 whose contents apply to all channels). The frequency number (FN) register 214 provides the frequency number that corresponds to the base frequency for all operators used to generate the corresponding channel. The connection register 218 describes the input and output connections that are to be made among the operators used to generate the channel (e.g., whether the channel represents the sum, serial modulation product, or some other combination of the operators making up the channel). Each connection register can take two values. This allows two associated connection registers to be used to specify the four possible operator combinations for a 4-operator voice and a single connection register to specify the two possible operator combinations for a 2-operator voice. Finally, the feedback register 220 specifies the feedback index ($\beta$) to be used to generate the output channel 123.

An operator register set includes a wave select (WS) register 222, frequency control register 224 and envelope register 226. The wave select (WS) register 222 specifies the wave select index (WS) for each operator. The frequency control register 224 indicates the frequency of an operator in relation to the base frequency (i.e., the FN for the channel). And the envelope register 226 defines the five parameters (attack rate, maximum level, decay rate, sustain level and release) used in the preferred embodiment to characterize the envelope (i.e., the loudness profile as a function of time) of each operator.

The state register and state circuitry are not user-programmable and are employed by the state machine 230 to control the audio synthesis operations of the audio synthesis engine 100. The state register 240 indicates the particular operator that is being played (in the preferred embodiment, this is an integer value between 1 and 52). This state information, data from the program registers 210–226 and information contained in the RAM 236 summarizing the previous phase ($\phi_{n-1}$) and amplitude ($A_{n-1}$) for each active operator are employed by the state circuitry to compute the data inputs (WS, $A_n$, $\beta$, FN) and control signals (mod_sel, adder_sel, and accum_sel) that determine the operator and, possibly, audio channel, that the audio synthesis circuitry 100 will generate in the current time slot. The state circuitry includes a modulation select circuit (modulation) 242, accumulator select circuit (accumulator) 244, adder select circuit (adder) 246 and amplitude control circuit 248, which are now described.

The modulation select circuit 242 sets the mod_sel signal 143 (FIG. 2C), which determines the operation of the modulation controller 120, based on the contents of the state register 240 and the connection registers 218 for the channel being synthesized. For example, when the state register 240 indicates that the first operator of a 2-operator channel is being played and the connection register 218 indicates that the first operator is not to modulate the second operator composing the channel (which the state machine 230 will compute immediately following the first operator), the modulation select circuit 242 will deassert the mod_sel signal 143 so that the modulation controller 120 will cause the all_zero input 141 to be output from the switch 142 to the adder 112 as the second operator is being computed.

The accumulator select circuit 244 sets the three accum_sel control signals to different predefined enumerated values (i.e., BLOCK, GO, or 0's) for each of the three switches S1, S2, S3 for each time slot based upon the contents of the connection register for the output channel being synthesized, thereby causing the output accumulator to form the output voice 123 from a different respective combination of the operators 117. For example, to generate an audio voice consisting of four serially modulated operators 1–4, the accumulator select circuit 244 would, over the course of four time slots, set the accum_sel signals to the select values shown in Table 1.

Similarly to the modulation select circuit, the adder select circuit 246, based on the contents of the connection register 118 and the state register 240, sets the adder_sel signal so as to cause the adder 112 to add either the feedback factor 119 or the modulation controller output 121 to the current accumulated phase value 111. For example, when an operator that corresponds to a modulating signal is being computed, the adder select circuit 246 asserts the adder_sel signal to cause the adder 112 to add the feedback factor 119 to the accumulated phase value 111. Otherwise, the adder select circuit 246 leaves the adder_sel signal unasserted so that the adder 112 inputs the output 121 from the modulation controller 120.

Finally, based on the current amplitude information that is stored in the RAM 236 and the data in the appropriate envelope register (i.e., attack, maximum level, decay rate, sustain level and release), the amplitude control circuit 248 computes and outputs the envelope amplitude ($A_n$) for the operator being computed in the current time slot.

Figure 5:
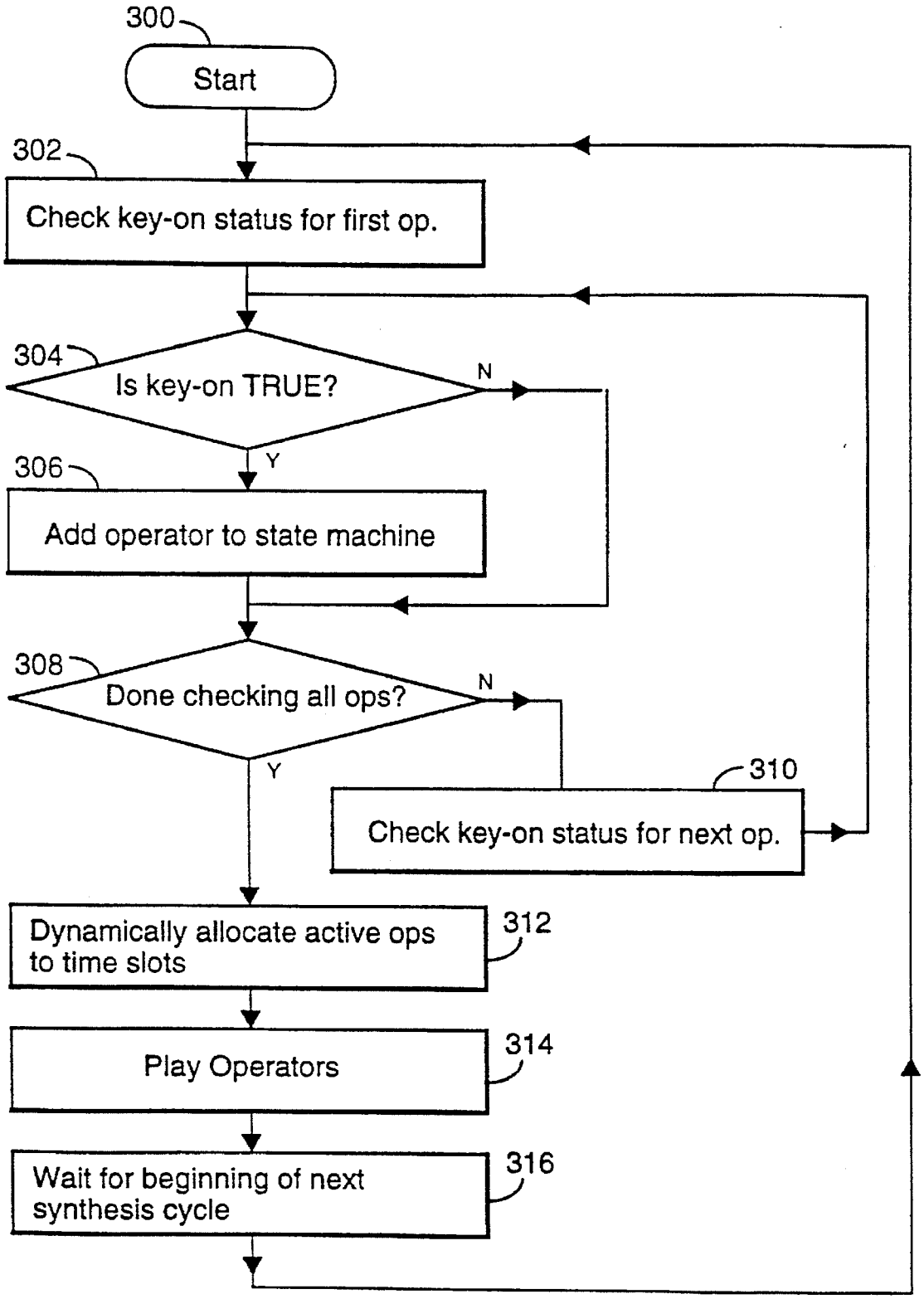
FIG. 5 is a flow chart illustrating the operation of the audio synthesis control circuitry of FIG. 4.

Referring to FIG. 5, there is shown a flow chart of the method by which the dynamic state machine 230 controls the audio synthesis circuitry 100. Note that all of the actions shown in FIG. 5 are performed by the state machine 230 in one audio synthesis cycle. At the beginning of the audio synthesis cycle, the state machine 230 visits the key-on register 210 associated with the first operator to determine whether that operator is to be played in the current cycle (302). If the contents of that key-on register are TRUE (304-YES), the state machine adds that operator to a list of active operators maintained by the time-slot program (306). If the contents of that key-on register are FALSE (304-NO), and it has not yet processed all of the key-on registers (308-NO), the state machine 230 visits the next key-on register, which it processes in the same manner (310). Once the state machine has visited all of the key-on registers (308-YES), the state machine runs the time slot program 234, which dynamically allocates the active operators to time slots of an audio synthesis cycle (312). I.e., the time slot program 234 specifies an order in which the operators are to be computed by the audio synthesis circuitry 100. Once the time slot program 234 has allocated the time slots, the dynamic state machine 230, at allocated time slot boundaries, passes outputs corresponding to the operator/channel to be played in that time slot to the audio synthesis engine 100, which computes the appropriate operator and combines that operator with previously-computed operators (to form a channel) as dictated by the mod_sel, accum_sel and adder_sel registers signals (314). After playing each operator, the dynamic state machine 230 updates the operator's current phase and amplitude information in the RAM 236. Once all of the operators have been played, the dynamic state machine 230 waits for the beginning of the next audio synthesis cycle (316).

For example, assume that a voice (e.g., voice 1) is being played that, as programmed, is the sum of two operators (e.g., op-1 and op-2) and that those two operators were scheduled by the time slot program to be computed in time slots one and two, respectively. When it is time for the audio synthesis circuitry 100 to compute op-1, the dynamic state machine 230 provides the FN, β, WS index, frequency control, envelope amplitude ($A_n$), modulation select (mod_sel), accumulator select (accum_sel) and adder select (adder_sel) for op-1 and voice 1. Using this information, during time slot 1, the audio synthesis circuitry 100 computes op-1. Then, based on the contents of the mod_sel and accum_sel signals, the circuitry 100 sets switches in the modulation controller and accumulator so that op-1 will be appropriately combined with the next computed op-2 to generate voice 1. For example, because voice 1 is the sum of op-1 and op-2, in time slot 1 the mod_sel signal is set so that the modulation controller 120 passes all zeros to the adder 112, the accum_sel signal is set so that the current value of op-1 is stored in the accumulator 122 but not yet output, and the adder_sel signal is set so the operator value 117 will be added to the accumulated phase for op-2 in the next time slot.

At the beginning of time slot 2, the dynamic state machine 230 provides similar information for op-2 and voice 1 (because op-1 and op-2 are both being combined to generate voice 1). Using this information, during time slot 2, the audio synthesis circuitry 100 computes op-2. Then, based on the contents of the accum_sel register, the output accumulator 122 stores op-2 separately from op-1 and then adds both operators to generate voice 1. Assuming that the key-on register for voice 1 is still set at the beginning of the next audio synthesis cycle, the dynamic state machine 230 would, during that cycle, compute the next values of operators 1 and 2 and voice 1, even though the operators might be played in different time slots as determined by the time slot program 234.

Having described the functional details of the preferred embodiment, we will now describe operational details of time slots and system modes as implemented by the preferred embodiment.

In the preferred embodiment, the circuitry 100 used to generate an operating unit is time-multiplexed with as few as 0 time slots to as many as 48 time slots per computation/synthesis cycle. As mentioned above, the number of time slots per cycle is dynamically determined by the dynamic state machine 230 based on the number of operators to be computed for each cycle (i.e., the number of channels for which key-on is TRUE). This approach allows as many as 48 operators to be computed using only the single audio synthesis engine 100 (FIG. 1). The operators are then dynamically allocated among the available time slots by a time-slot program 234 (FIG. 4).

For example, if only one 2-operator channel were being generated using the operators 1 and 5 (where operator 1 might correspond to the modulation signal and operator 5 the carrier), the time slot program 234 would locate those two operators in time slots 1 and 2, respectively. In this example, no other operators are on, thus, no additional time slots are clocked. This dynamic approach reduces the number of clock and computation cycles and therefore reduces chip power dissipation. In this example, the clock would not start again until the first time slot of the next computation cycle. Because the time-slot program 234 is dynamic, if another two operators were turned on in a subsequent cycle, the time slot program 234 would locate those operators in slots 3 and 4.

In contrast, some prior art audio synthesis circuits define a fixed number of time slots (e.g, 36 time slots), each being allocated to a fixed operator. For example, in the prior art, time slots 1 and 5 might always be assigned to the first and fifth operators, respectively. Thus, assuming that only the two operators 1 and 5 were being played at a particular time, the prior art chip would still generate thirty-six clocks and computation cycles, even though it uses only the first and the fifth time slots to compute the two-operator voice 1,5.

The preferred embodiment makes use of these dynamic time slots to simultaneously compute up to 48 operators and output the voices/channels formed from pre-programmed combinations of those operators. In the preferred embodiment, these channels have a fixed relationship to the operators they comprise (e.g., channel/voice 1 might always be formed from some combination of operators 1 and 2). Of course, the inputs (e.g., WS, $A_n$, β, etc. ) that determine how the operators are computed and then combined to form their associated voice/channel can always be varied using the programmer 232. However, the freedom with which the operators and voices can be programmed is subject to certain limitations that follow from the audio synthesis mode settings of the preferred embodiment, which are now described.

The preferred embodiment provides 48 melody operators and four percussion operators. These operators are used to define six 4-operator channels, twelve 2-operator channels and four percussion channels, where a "channel", also called a "voice", is some combination of the operators (except for a percussion channel, which is a single operator) that defines a desired sound. One significant aspect of the preferred embodiment is that the number of channels is fixed; i.e., using the 52 operators, a user can never specify more than 18 simultaneous melody voices and 4 simultaneous percussion voices (Note: as mentioned above, due to time-division multiplexing used in the preferred embodiment, only 48 operators can be simultaneously synthesized, and, as percussion channels have precedence over melody channels, each specified percussion channel eliminates one operator from a predetermined 2-operator voice, meaning that playing all four percussion channels preempts two 2-operator voices).

Table 3, which follows, shows one possible arrangement of 48 melody channels into the six 4-operator channels and twelve 2-operator channels. Of course, different arrangements of the 48 melody operators are also possible.

TABLE 3

| Voice | Operators | Voice | Operators |
|---|---|---|---|
| 1 | 1,2,3,4 | 2 | 5,6 |
| 3 | 7,8,9,10 | 4 | 11,12 |
| 5 | 13,14,15,16 | 6 | 17,18 |
| 7 | 19,20,21,22 | 8 | 23,24 |
| 9 | 25,26,27,28 | 10 | 29,30, |
| 11 | 31,32,33,34 | 12 | 35,36 |
| 13 | 37,38 | 14 | 39,40 |
| 15 | 41,42 | 16 | 43,44 |
| 17 | 45,46 | 18 | 47,48 |

Using this operator/channel arrangement, the preferred embodiment is able to provide three operational modes:

(1) backward-compatible 4-operator/voice mode (4-op mode);

(2) backward-compatible 2-operator/voice mode (2-op mode); and (3) enhanced mode.

Note that each of the backward-compatible modes can be specified for a subset of the voices shown in Table 3. For example, the user could specify that the voices 1, 3, 5, 7 and 10, 12, 14, 16 and 18 be played in 2-op mode and the voices 9, 11 in 4-op mode. However, if enhanced mode is selected, that selection applies to the entire set of voices. Thus, in the preferred embodiment, there is a single, enhanced mode register 212 in the control circuitry 200, whereas there is a mode register 216 for each of the 18 possible melody voices. Priority is given to the contents of the enhanced mode register 112; so, regardless of the settings of the mode registers, if the enhanced mode register is set, the control circuitry 200 will only allow the audio synthesis system to be programmed and played in enhanced mode. The main difference between the backward compatible modes and the enhanced mode are due to limitations that are placed on the programming of operators and voices in the backward-compatible modes.

In the backward compatible modes (i.e., modes 1 and 2) the preferred embodiment requires that the last two operators of each 4-operator channel be mapped into a corresponding 2-operator channel. For example the operators 5 and 6 (the two operators making up channel/voice 2 from Table 3) would be identical to the operators 3 and 4 (two of the operators making up channel/voice 1), respectively. This is accomplished in the preferred embodiment by "shadowing" the contents of the operator registers 220–226 for the two operator voice (i.e., operators 5 and 6) to the last two operator registers for the four-operator voice (i.e., operators 3 and 4). Also, when a 4-operator voice (such as voice 1) is played in 2-op mode, the output connections between the two operators are determined by only the first connection register 218 for the 4-operator voice. This is because in the preferred embodiment there are only two possible 2-operator voices (as opposed to the four possible 4-operator voices).

Figure 6:
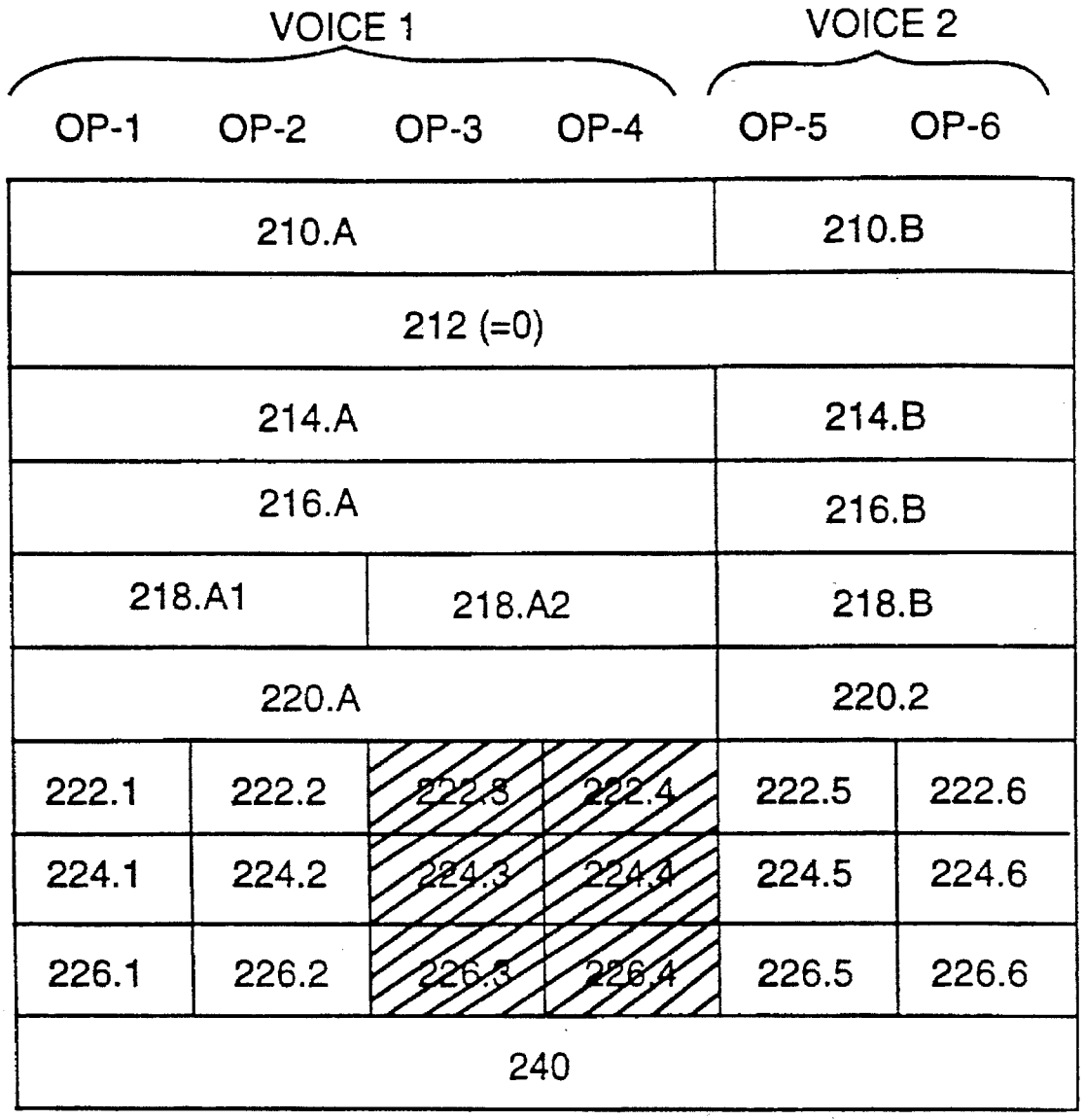
FIG. 6 is a diagram that shows the organization of the program registers for operators 1 through 6.

For example, see FIG. 6, which shows how the operator and channel registers are setup for voice 1 (operators 1–4) and voice 2 (operators 5–6) when the system is in either of backward-compatible modes. In this figure, the shading of registers 222.3–226.3 and 222.4–226.4 indicate that these registers are shadowing the contents of the registers 222.5–226.5 and 222.6–226.6. Note that this shadowing is enabled by zeroing out the contents of the enhanced mode register 212. As mentioned above, there is one set of channel registers for each voice (the enhanced mode register 212 excepted). Thus, the channel register set for voice 1 includes the key-on register 210.A, FN register 214.A, channel mode register 216.A, two connection registers 218A.A1 and 218.A2 and the feedback register 220.A. The voice 2 channel registers 210.B, 212.B, 214.B, 218.B, 220.B differ from those of voice 1 in that the voice 2 registers include a single connection register 218.B rather than the two connection registers 218.A1–218.A2 for voice 1. This is because voice 2 is a 2-operator voice, whereas voice 1 is a 4-operator voice. FIG. 6 also shows the state registers 240–248.

As a consequence of this register shadowing, in the backward-compatible modes, the user cannot program the 48 melody operators as 24, 2-operator voices or as 12, 4-operator voices. Instead, a user wanting to play only 2-operator channels is limited to the use of the pre-defined two-operator channels (12) and two of the operators associated with a 4-operator channel (6), for a total of 18 2-operator channels. They cannot use the remaining 12 operators from the 4-operators channels to form another 6, two-operator voices because those additional 12 operators are identical to respective ones of the 12, predefined two-operator channels.

These relationships between the 2- and 4-operator, backward-compatible modesare enforced by the control circuitry 200, which selectively turns off operators based on the voices being simultaneously played. That is, If a user selects the 4-op mode for a given 4-operator channel, playing that 4-operator channel turns off a corresponding 2-operator channel. For example, if the user plays channel 1 (comprising the operators 1,2,3,4) in 4-op mode, they could not simultaneously play channel 2 (comprising the operators 5,6, which are, in 4-op or 2-op modes, identical to the operators 3,4). For similar reasons, if the user specifies the 2-op mode, playing a 2-operator voice would turn off the corresponding two operators in a 4-operator voice. For example, if the user plays channel 2 (ops-5,6) they cannot also simultaneously play channel 1 (ops-1,2,3,4). However, as mentioned above, a user can play channels 2 (ops-5,6) and operators 1 and 2 of channel 1, simultaneously.

If the user selects the enhanced mode, where backward compatibility is not an issue, all of the operators of the 2-operator and the 4-operator channels can be used simultaneously, as long as the total number of operators (including melody and percussion operators) being used does not exceed 48 in number. The enhanced mode approach is more flexible than the prior art approach as, in the enhanced mode, any 2-op channel can be synthesized simultaneously with any 4-op channel. In contrast, in the prior art, generating a 2-op channel means that a corresponding 4-op channel cannot be generated.

The present invention could be employed in audio synthesis systems where audio channels are composed of different numbers of operators. For example, a programmed six-operator audio channel could still be played in the present system after truncation, in which only four of the operators are played in the 4-op mode and two of the operators are played in the 2-op mode. Additionally, an alternative embodiment of the present invention could be employed with N-operator channels, where N is a multiple of two and one of the two backward compatible modes is a N/2 operator mode.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. A mode selection system for use with an audio synthesis system that is configured to generate audio tones, or operators, and combine unique subsets of said operators to form a plurality of respective melody channels, said mode selection system comprising:

a plurality of mode registers equal in number to said plurality of channels, each of said mode registers indicating for a respective one of said channels a channel mode in which said channel is to be played, said channel mode being selected from a N/2-operator mode or a N-operator mode, N being an even integer greater than 2, said channel modes being independently selectable in that said channel mode of one channel never determines said channel mode of another channel; and a dynamic state machine that controls operations of said audio synthesis system based at least partly on contents of said mode registers;

wherein, when said channel mode is said N/2-operator mode, said dynamic state machine causes said audio synthesis system to play N/2 of said subset of operators composing said channel when said channel is activated, the operators unplayed for one channel in said N/2-operator mode never being used as one of said subset of said operators composing another said channel, and when said channel mode is said N-operator mode, said dynamic state machine causes said audio synthesis system to play the lesser of: (1) N of said subset of operators composing said channel and (2) all of said subset of operators when said channel is activated, the number of available channels always being a fixed number regardless of said channel modes respectively selected for said channels.

2. The mode selection system of claim 1, wherein said plurality of channels includes a set of N/2-operator channels having N/2 operators and a set of N-operator channels having N operators, further comprising:

an enhanced mode register that indicates an enhanced mode status for all of said channels;

such that, when said enhanced mode status is "backward-compatible", said dynamic state machine causes a number of said N-operator channels and a like number of said N/2-operator channels to be respectively associated, said dynamic state machine constraining each operator of said like number of said N/2-operator channels to be duplicated as a respective operator of said associated N-operator channel.

3. The mode selection system of claim 2, wherein, when said channel mode for a particular N-operator channel is said N/2-operator mode and said particular channel is activated, said dynamic state machine causes said audio synthesis system to play operators from said particular channel that are not duplicates of operators from said particular channel's associated N/2-operator channel.

4. The mode selection system of claim 2, wherein, when said channel mode for a particular N-operator channel is said N-operator mode and said particular channel is being played by said audio synthesis system when said particular channel's associated N/2-operator channel is activated, said dynamic state machine causes said audio synthesis system to not play said N/2-operator channel.

5. The mode selection system of claim 2, wherein, when said channel mode for a particular N-operator channel is said N-operator mode and said particular channel is activated while said particular channel's associated N/2-operator channel is being played by said audio synthesis system, said dynamic state machine causes said audio synthesis system to not play those operators of said particular channel that are duplicates of said operators of said associated N/2-operator channel.

6. The mode selection system of claim 2, wherein, when said enhanced mode status is "enhanced-mode", said dynamic state machine allows said channels to be freely programmed and played by said audio synthesis system such that all operators of all said channels can be simultaneously played subject only to the number of said operators said audio synthesis system can play simultaneously.

7. The mode selection system of claim 1, wherein N is 4.

8. The mode selection system of claim 7, wherein said melody channels comprise twelve 2-operator channels and six 4-operator channels.

9. The mode selection system of claim 1, wherein some of said operators can also be used to form percussion channels, each of said percussion channels being formed by said audio synthesis system from one of said some operators.

10. The mode selection system of claim 9, wherein N is 4.

11. The mode selection system of claim 10, wherein said melody channels comprise twelve 2-operator channels and six 4-operator channels and said percussion channels comprise 4 one-operator channels.

12. The mode selection system of claim 11, wherein:

when a plurality of said percussion and melody channels are active, said plurality incorporating a number of operators that is greater than the 48 operators said audio synthesis system can play simultaneously, said dynamic state machine turns off a predetermined one of said active 2-operator melody channels for every said active percussion channel until the total number of operators to be played falls below 48, the 2-operator melody channel being turned off for second and fourth active percussion channels being the same as the 2-operator melody channels turned off for first and third percussion channels, respectively.

13. The mode selection system of claim 1, wherein:

said audio synthesis system plays each said operator caused to be played by said dynamic state machine in a respective time slot of an audio synthesis cycle; and said dynamic state machine limits the number of said time slots per said cycle to the lesser of (a) the number of said operators to be played in said cycle and (b) the maximum number of said time slots that can be allocated to one said cycle, thereby decreasing power consumption of said audio synthesis system due to generation of unnecessary clock and computation cycles.

14. The mode selection system of claim 13, further comprising:

a time slot program configured to allocate said operators caused to be played by said dynamic state machine to the limited set of time slots allowed by said dynamic state machine so that said operators composing a channel are allocated to contiguous time slots.

15. A mode selection method for use with an audio synthesis system that is configured to generate audio tones, or operators, and combine unique subsets of said operators to form a plurality of respective audio voices, or melody channels, said mode selection method comprising the steps of:

individually setting for said melody channels a channel mode in which each of said melody channels is to be played, said channel mode being selected from a N/2-operator mode or a N-operator mode, N being an even integer greater than 2, said channel modes being independently selectable in that said channel mode of one channel never determines said channel mode of another channel, each of said melody channels being selected from an N/2-operator channel and a N-operator channel; and controlling channel formation operations of said audio synthesis system based at least partly on said channel modes, said controlling step including:

when said channel mode for any melody channel is said N/2-operator mode, causing said audio synthesis system to play N/2 of said subset of operators composing said any melody channel when said any melody channel is activated, the operators unplayed for one channel in said N/2-operator mode never being used as one of said subset of said operators composing another said channel, and when said channel mode for any melody channel is said N-operator mode and said any melody channel is activated, causing said audio synthesis system to play the lesser of: (1) N of said subset of operators composing said melody channel, and (2) all of said subset of operators composing said melody channel, so that the number of available melody channels is always a fixed number regardless of said channel modes respectively selected for said channels.

16. The mode selection method of claim 15, further comprising the steps of:

setting an enhanced mode status for all of said subset of channels; and when said enhanced mode status is "backward-compatible", respectively associating a number of said N-operator channels and a like number of said N/2-operator channels; and constraining each operator of said like number of said N/2-operator channels to be duplicated as a respective operator of said associated N-operator channel.

17. The mode selection method of claim 16, further comprising the step of:

when said channel mode for a particular N-operator channel is said N/2-operator mode and said particular channel is activated, causing said audio synthesis system to play operators from said particular channel that are not duplicates of operators from said particular channel's associated N/2-operator channel.

18. The mode selection method of claim 16, further comprising the step of:

when said channel mode for a particular N-operator channel is said N-operator mode and said particular channel is being played by said audio synthesis system when said particular channel's associated N/2-operator channel is activated, causing said audio synthesis system to not play said associated N/2-operator channel.

19. The mode selection method of claim 16, further comprising the step of:

when said channel mode for a particular N-operator channel is said N-operator mode and said particular channel is activated while said particular channel's associated N/2-operator channel is being played by said audio synthesis system, causing said audio synthesis system to not play those operators of said particular channel that are duplicates of said operators of said associated N/2-operator channel.

20. The mode selection method of claim 16, further comprising the step of:

when said enhanced mode status is "enhanced-mode", allowing said channels to be freely programmed and played by said audio synthesis system such that all operators of all said channels can be simultaneously played subject only to the number of said operators said audio synthesis system can play simultaneously.

21. The mode selection method of claim 15, wherein N is 4.

22. The mode selection method of claim 21, wherein said melody channels comprise twelve 2-operator channels and six 4-operator channels.

23. The mode selection method of claim 15, wherein some of said operators can also be used to form percussion channels, each of said percussion channels being formed by said audio synthesis system from one of said some operators.

24. The mode selection method of claim 23, wherein N is 4.

25. The mode selection method of claim 24, wherein said melody channels comprise twelve 2-operator channels and six 4-operator channels and said percussion channels comprise 4 one-operator channels.

26. The mode selection method of claim 25, further comprising the step of:

when a plurality of said percussion and melody channels are active, said plurality incorporating a number of operators that is greater than the 48 operators said audio synthesis system can play simultaneously, turning off a predetermined one of said active 2-operator melody channels for every said active percussion channel until the total number of operators to be played falls below 48, the 2-operator melody channel being turned off for second and fourth active percussion channels being the same as the 2-operator melody channels turned off for first and third percussion channels, respectively.

* * * * *

UNITED STATES PATENT AND TRADEMARK OFFICE
CERTIFICATE OF CORRECTION

PATENT NO. : 5,639,979 Page 1 of 2

DATED : June 17, 1997

INVENTOR(S) : Iou-Din Jean Chen, Jimmy G. Lo

It is certified that error appears in the above-identified patent and that said Letters Patent is hereby corrected as shown below:

In the Drawings, Fig. 2A,
remove wording from box labelled "Phase Accumulator (Øn-1)" and insert --log-Sinusoid Computing Circuit--.

remove wording from middle box and insert --Adder--.

above the $A_n \sin(y'_n)$ 117 line, insert --124-- with an arrow pointing to the line , as shown on the attached page.

Signed and Sealed this

Second Day of December, 1997

*Attest:*

Bruce Lehman

BRUCE LEHMAN

*Attesting Officer*

*Commissioner of Patents and Trademarks*